US012800182B2

(12) United States Patent
Li et al.

(10) Patent No.: US 12,800,182 B2
(45) Date of Patent: Nov. 17, 2026

(54) ENERGY RECOVERY VENTILATOR

(71) Applicant: DELTA ELECTRONICS, INC., Taoyuan City (TW)

(72) Inventors: Shu-Che Li, Taoyuan City (TW); Li-Chun Chang, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 227 days.

(21) Appl. No.: 18/932,472

(22) Filed: Oct. 30, 2024

(65) Prior Publication Data

US 2025/0137681 A1 May 1, 2025

Related U.S. Application Data

(60) Provisional application No. 63/546,590, filed on Oct. 31, 2023.

(51) Int. Cl.
*F24F 12/00* (2006.01)

(52) U.S. Cl.
CPC ..... *F24F 12/006* (2013.01)

(58) Field of Classification Search
CPC ..... F24F 12/006
See application file for complete search history.

(56) References Cited

U.S. PATENT DOCUMENTS

2006/0151165 A1* 7/2006 Poirier ..... F24F 12/006 165/59
2011/0189937 A1* 8/2011 Hasegawa ..... F24F 12/006 454/239

FOREIGN PATENT DOCUMENTS

| | | | |
|---|---|---|---|
| CN | 107747777 | A | 3/2018 |
| CN | 214249810 | U | 9/2021 |
| CN | 214469099 | U | 10/2021 |
| CN | 215523635 | U | 1/2022 |

* cited by examiner

*Primary Examiner* — Eric S Ruppert
(74) *Attorney, Agent, or Firm* — HDLS IPR SERVICES; Chun-Ming Shih

(57) ABSTRACT

An energy recovery ventilator is disclosed. An outside air (OA) inlet, an exhaust air (EA) outlet, a return air (RA) inlet and a supply air (SA) outlet are disposed on a casing. An energy recovery core is disposed in the casing and includes a first inlet surface and a second inlet surface. A first fan set includes a first open blower and a first bracket. The first open blower is oriented towards the OA inlet through the first bracket. A second fan set includes a second open blower and a second bracket. The second open blower is oriented toward the RA inlet through the second bracket.

17 Claims, 12 Drawing Sheets

ENERGY RECOVERY VENTILATOR

CROSS-REFERENCE TO RELATED APPLICATION

This patent application claims the benefit of U.S. Provisional Patent Application No. 63/546,590, filed Oct. 31, 2023, which is incorporated by reference herein.

BACKGROUND OF THE DISCLOSURE

Technical Field

The technical field relates to a ventilation device, and particularly to an energy recovery ventilator.

Description of Related Art

In an existing bidirectional ventilation system, the axis of the impeller of the fan is usually aligned and parallel to the center of the air outlet. Moreover, since the diameter of the impeller directly affects the delivery efficiency of fresh air and exhaust air, a larger diameter impeller is used to improve air supply efficiency.

However, as the diameter of the impeller increases, the size of the fan housing also needs to increase accordingly to provide sufficient space for airflow and avoid generating turbulence. Therefore, the host of a bidirectional ventilation system usually has the disadvantage of being large and heavy, which not only occupies a larger indoor space but also makes installation more difficult due to the increased weight.

In this regard, the research motivation of the applicant is to optimize the airflow path and increase the flow rate of outdoor air to improve temperature and energy recovery efficiency, while also achieving a compact size and lightweight characteristics to facilitate transportation and installation.

In view of the above drawbacks, the inventor proposes this disclosure based on his expert knowledge and elaborate researches in order to solve the problems of related art.

SUMMARY OF THE DISCLOSURE

This disclosure provides an energy recovery ventilator to optimize the airflow path and increase the flow rate of outdoor air, thereby improving the temperature and energy recovery efficiency.

This disclosure provides a thin type of energy recovery ventilator with a small size, compact structure, and lightweight design, which may meet the installation requirements in small spaces and is easy to transport and install.

This disclosure is an energy recovery ventilator including a housing, an energy recovery core, a first fan set, and a second fan set. The housing includes a casing and a cover plate covering the casing. An outside air inlet and an exhaust air outlet are defined on one side of the casing, and a return air inlet and a supply air outlet are defined on another side of the casing. The energy recovery core is disposed in the casing and includes a first inlet surface facing the outside air inlet and a second inlet surface facing the return air inlet. The first fan set includes a first open blower, a first guiding plate, and a first bracket. The first guiding plate is disposed between the outside air inlet and the first open blower. The first bracket supports and orients the first open blower to position one end of an axis of the first open blower toward the outside air inlet and another end of the axis toward the first inlet surface of the energy recovery core. The second fan set includes a second open blower, a second guiding plate and a second bracket. The second guiding plate is disposed between the return air inlet and the second open blower. The second bracket supports and orients the second open blower to position one end of an axis of the second open blower toward the return air inlet and another end of the axis toward the second inlet surface of the energy recovery core. Outdoor air passes through the first guiding plate via the outside air inlet, enters the energy recovery core through the first open blower, and then flows out from the supply air outlet. Indoor air passes through the second guiding plate via the return air inlet, enters the energy recovery core through the second open blower, and then flows out from the exhaust air outlet.

This disclosure is an energy recovery ventilator including a housing, an energy recovery core, an air damper, a first fan set, and a second fan set. The housing includes a casing and a cover plate covering the casing. The casing includes a plurality of partitions, wherein an outside air inlet and an exhaust air outlet are defined on one side of the casing, and a return air inlet and a supply air outlet are defined on another side of the casing. The energy recovery core is disposed in the casing and includes a first inlet surface facing the outside air inlet, a second inlet surface facing the return air inlet, a first outlet surface opposite the first inlet surface, and a second outlet surface opposite the second inlet surface. The partitions of the casing and the energy recovery core separate an interior of the casing into a first space, a second space, a third space, and a fourth space. The first space is defined as a space between the outside air inlet and the energy recovery core. The second space is defined as a space between the exhaust air outlet and the energy recovery core. The third space is defined as a space between the supply air outlet and the energy recovery core. The fourth space is defined as a space between the return air inlet and the energy recovery core. The air damper is disposed between the first space and the second space. The first fan set is disposed in the first space and comprising a first open blower. The second fan set is disposed in the third space and comprising a second open blower. Indoor air flows into the housing from the return air inlet, enters the second open blower, then enters the energy recovery core from the second inlet surface, flows out of the energy recovery core from the second outlet surface and enters the second space, enters the first space through the air damper, enters the energy recovery core from the first inlet surface, flows out of the energy recovery core from the first outlet surface, and flows out via the exhaust air outlet.

This disclosure is an energy recovery ventilator including a housing, an energy recovery core, an air damper, a first fan set, and a second fan set. The housing includes a casing and a cover plate covering the casing. The casing includes a plurality of partitions. An outside air inlet and an exhaust air outlet are defined on one side of the casing. A return air inlet and a supply air outlet are defined on another side of the casing. The energy recovery core is disposed in the casing and includes a first inlet surface facing the outside air inlet, a second inlet surface facing the return air inlet, a first outlet surface opposite the first inlet surface, and a second outlet surface opposite the second inlet surface. The partitions of the casing and the energy recovery core separate an interior of the casing into a first space, a second space, a third space, and a fourth space. The first space is defined as a space between the outside air inlet and the energy recovery core. The second space is defined as a space between the exhaust air outlet and the energy recovery core. The third space is defined as a space between the supply air outlet and the energy recovery core. The fourth space is defined as a space between the return air inlet and the energy recovery core. The air damper is disposed between the first space and the second space. The first fan set is disposed in the first space and includes a first open blower, a first guiding plate, and a first bracket. The first guiding plate is disposed between the outside air inlet and the first open blower. The first bracket supports and orients the first open blower to position one end of the axis of the first open blower toward the outside air inlet and the other end of the axis toward the first inlet surface of the energy recovery core. The second fan set is disposed in the third space and comprising a second open blower, a second guiding plate, and a second bracket. The second guiding plate is disposed between the return air inlet and the second open blower. The second bracket supports and orients the second open blower to position one end of the axis of the second open blower toward the return air inlet and the other end of the axis toward the second inlet surface of the energy recovery core. Outdoor air passes through the first guiding plate via the outside air inlet, enters the energy recovery core through the first open blower, and then flows out from the supply air outlet. Indoor air passes through the second guiding plate via the return air inlet, enters the energy recovery core through the second open blower, and then flows out from the supply air outlet. Indoor air flows into the housing from the return air inlet, enters the second open blower, then enters the energy recovery core from the second inlet surface, flows out of the energy recovery core from the second outlet surface and enters the second space, enters the first space through the air damper, enters the energy recovery core from the first inlet surface, flows out of the energy recovery core from the first outlet surface, and flows out via the supply air outlet.

In one embodiment of this disclosure, the first open blower and the second open blower are centrifugal fan impellers without volutes.

In one embodiment of this disclosure, a first damper is disposed on the outside air inlet of the housing for electrically controlling the opening and closing of the outside air inlet, and a second damper is disposed on the exhaust air outlet of the housing for electrically controlling the opening and closing of the exhaust air outlet.

In one embodiment of this disclosure, the casing comprises a plurality of partitions, the partitions and the energy recovery core separate an interior of the casing into a first space, a second space, a third space, and a fourth space. The first space is defined as a space between the outside air inlet and the energy recovery core, the second space is defined as a space between the exhaust air outlet and the energy recovery core, the third space is defined as a space between the supply air outlet and the energy recovery core, and the fourth space is defined as a space between the return air inlet and the energy recovery core. The first fan set is located in the first space, and the second fan set is located in the third space.

In one embodiment of this disclosure, a center line is defined on the casing, a diagonal line is defined on the energy recovery core, and the energy recovery core is arranged in the casing by an offset angle between the diagonal line and the center line.

In one embodiment of this disclosure, the first bracket is disposed between the outside air inlet and the energy recovery core and comprises a first supporting plate and a first base plate, and the first open blower is disposed on the first supporting plate and comprises a first motor. The first supporting plate is attached to a bottom of the first motor, and the first base plate comprises a first rear edge. A first angle is defined between the first rear edge and X-axis, and the first rear edge faces the first inlet surface of the energy recovery core. The second bracket is disposed between the return air inlet and the energy recovery core and comprises a second supporting plate and a second base plate, and the second open blower is disposed on the second supporting plate and comprises a second motor. The second supporting plate is attached to a bottom of the second motor, and the second base plate comprises a second rear edge. A second angle is defined between the second rear edge and X-axis, and the second rear edge faces the second inlet surface of the energy recovery core.

In one embodiment of this disclosure, the first open blower further comprises a first impeller driven by the first motor, a first outer diameter is defined on the first impeller, a plate width is defined on the first supporting plate, and the plate width is equal to or less than the first outer diameter.

In one embodiment of this disclosure, the first open blower is supported by the first bracket and rotates in a first rotating direction. A first normal direction is defined on the first supporting plate, and the first normal direction is parallel to the first rotating direction. A first offset angle is defined between the first normal direction and Z-axis. The second open blower is supported by the second bracket and rotates in a second rotating direction. A second normal direction is defined on the second supporting plate, and the second normal direction is parallel to the second rotating direction. A second offset angle is defined between the second normal direction and Z-axis.

In comparison with the related art, the first fan set of this disclosure is oriented toward the outside air inlet through the disposition of the first bracket to increase the airflow space between the first fan set and the housing, which optimizes the air inlet to allow outdoor air to flow smoothly into the housing, thereby improving the efficiency of the supply air entering indoors. Furthermore, the second fan set of this disclosure is oriented toward the return air inlet through the disposition of the second bracket to increase the airflow space between the second fan set and the housing, which optimizes the air inlet to allow indoor air to flow out of the housing smoothly, thereby improving the efficiency of the exhaust air releasing from indoors and enhancing the overall efficiency of the energy recovery ventilator. Moreover, since the energy recovery ventilator of this disclosure optimizes the airflow path and enhances the delivery efficiency of fresh air and exhaust air, the temperature and energy exchange efficiency are improved. As a result, the energy recovery ventilator may achieve the effects of small size, thinness, and compact structure. Therefore, a lightweight design is achieved for easy transportation and installation to satisfy the requirement of installation in small spaces.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
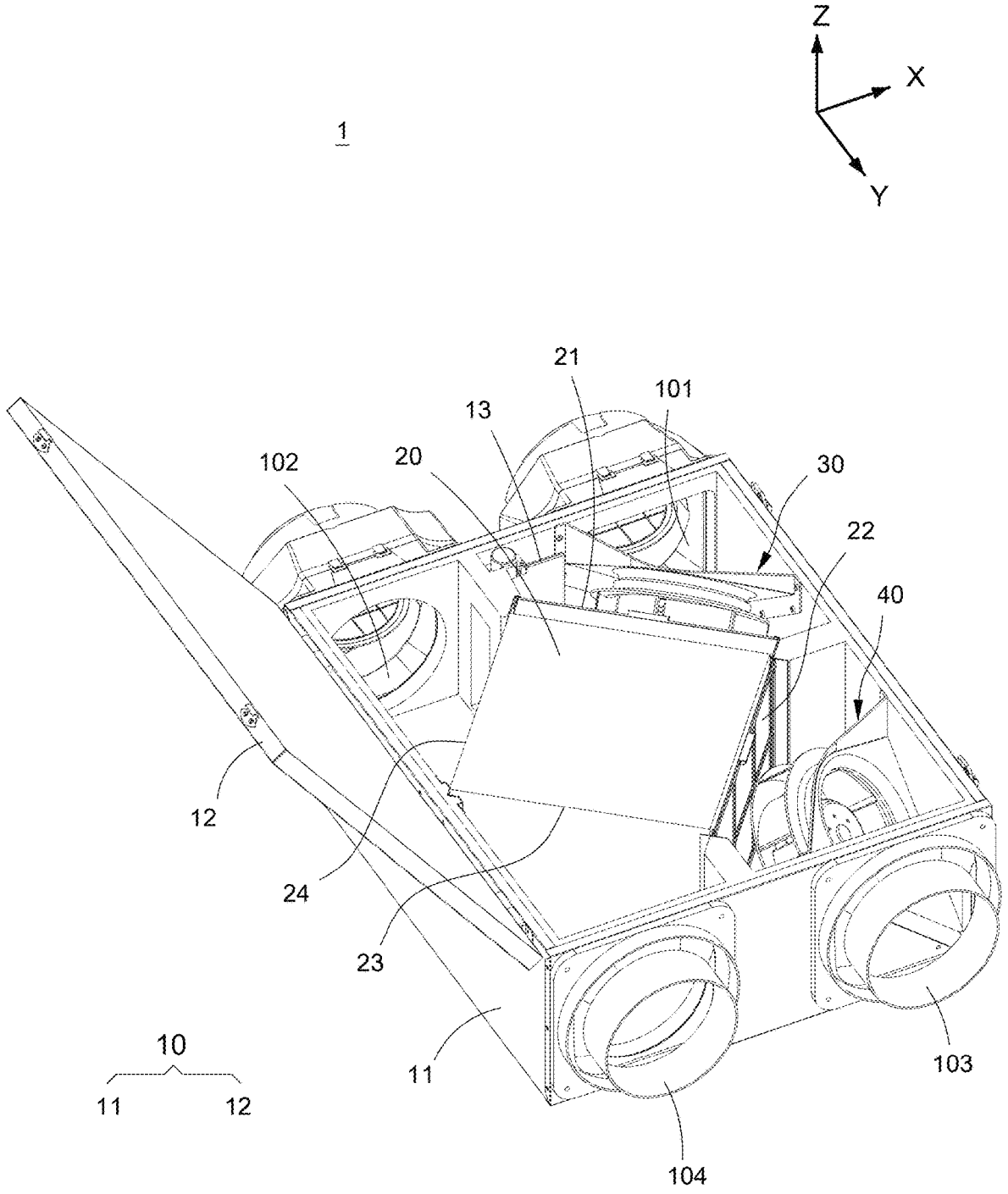
FIG. 1 depicts a perspective schematic view of the energy recovery ventilator according to this disclosure.

Please refer to FIG. 1, which depicts a perspective schematic view of the energy recovery ventilator according to this disclosure. An energy recovery ventilator 1 of this disclosure includes a housing 10, an energy recovery core 20, a first fan set 30, and a second fan set 40. The energy recovery core 20, the first fan set 30, and the second fan set 40 are arranged in the housing 10. The first fan set 30 and the second fan set 40 are located on two adjacent sides of the energy recovery core 20.

The housing 10 includes a casing 11 and a cover plate 12 covering the casing 11. An outside air inlet 101 (OA inlet) and an exhaust air outlet 102 (EA outlet) are defined on one side of the casing 11, and a return air inlet 103 (RA inlet) and a supply air outlet 104 (SA outlet) are defined on opposite side. Additionally, an air damper 13 is disposed between the outside air inlet 101 and the exhaust air outlet 102.

The energy recovery core 20 is disposed in the casing 11. The energy recovery core 20 includes a first inlet surface 21 facing the outside air inlet 101, a second inlet surface 22 facing the return air inlet 103, a first outlet surface 23 opposite the first inlet surface 21, and a second outlet surface 24 opposite the second inlet surface 22. Moreover, the first fan set 30 is located between the outside air inlet 101 and the first inlet surface 21. The second fan set 40 is located between the supply air outlet 104 and the second inlet surface 22.

Figure 2:
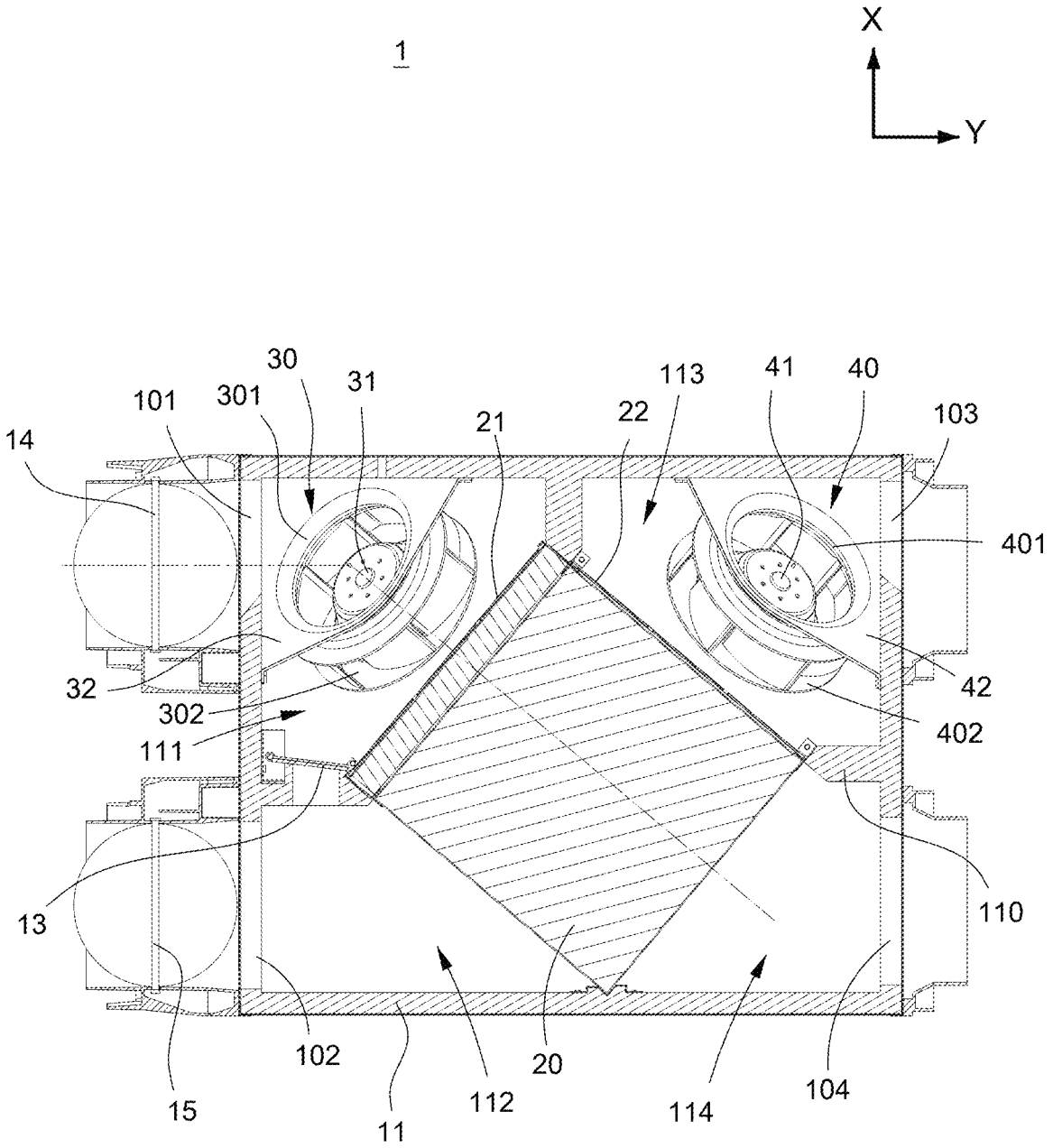
FIG. 2 depicts a cross-sectional schematic view of the energy recovery ventilator according to this disclosure.

Please refer to FIG. 2, which depicts a cross-sectional schematic view of the energy recovery ventilator according to this disclosure. The first fan set 30 includes a first open blower 31 and a first guiding plate 32, and the first open blower 31 is configured without a volute. A first fan inlet 301 and a first fan outlet 302 are arranged on two sides of the first open blower 31 opposite to each other. The first fan inlet 301 faces the outside air inlet 101, and the first fan outlet 302 is directed toward the first inlet surface 21 of the energy recovery core 20. Additionally, the first guiding plate 32 is disposed between the outside air inlet 101 and the first open blower 31. Thus, the airflow entering via the outside air inlet 101 may pass through the first fan inlet 301 and flow out from the first fan outlet 302 of the first open blower 31.

Please further refer to FIG. 2. The second fan set 40 includes a second open blower 41 and a second guiding plate 42, and the second open blower 41 is configured without a volute. A second fan inlet 401 and a second fan outlet 402 are arranged on two sides of the second open blower 41 opposite to each other. The second fan inlet 401 faces the return air inlet 103, and the second fan outlet 402 is directed toward the second inlet surface 22 of the energy recovery core 20. Additionally, the second guiding plate 42 is disposed between the return air inlet 103 and the second open blower 41. Thus, the airflow entering via the return air inlet 103 may pass through the second fan inlet 401 and flow out from the second fan outlet 402 of the second open blower 41.

In this embodiment, a first damper 14 is disposed on the outside air inlet of the housing 10 for electrically controlling the opening and closing of the outside air inlet 101. Additionally, a second damper 15 is disposed on the exhaust air outlet 102 of the housing 10 for electrically controlling the opening and closing of the exhaust air outlet 102. The first damper 14 and the second damper 15 are driven by two stepper motors, respectively.

Specifically, the casing 11 includes a plurality of partitions 110. The partitions 110 and the energy recovery core 20 separate the interior of the casing 11 into a first space 111, a second space 112, a third space 113, and a fourth space 114. The first space 111 is defined as the space between the outside air inlet 101 and the energy recovery core 20. The second space 112 is defined as the space between the exhaust air outlet 102 and the energy recovery core 20. The third space 113 is defined as the space between the supply air outlet 104 and the energy recovery core 20. The fourth space 114 is defined as the space between the return air inlet 103 and the energy recovery core 20. The first fan set 30 is disposed in the first space 111. The second fan set 40 is disposed in the third space 113. The air damper 13 is disposed between the first space 111 and the second space 112. Additionally, the airflow flowing out from the first fan outlet 302 of the first open blower 31 enters the first space 111. The airflow flowing out from the second fan outlet 402 of the second open blower 41 enters the third space 113.

Figure 3:
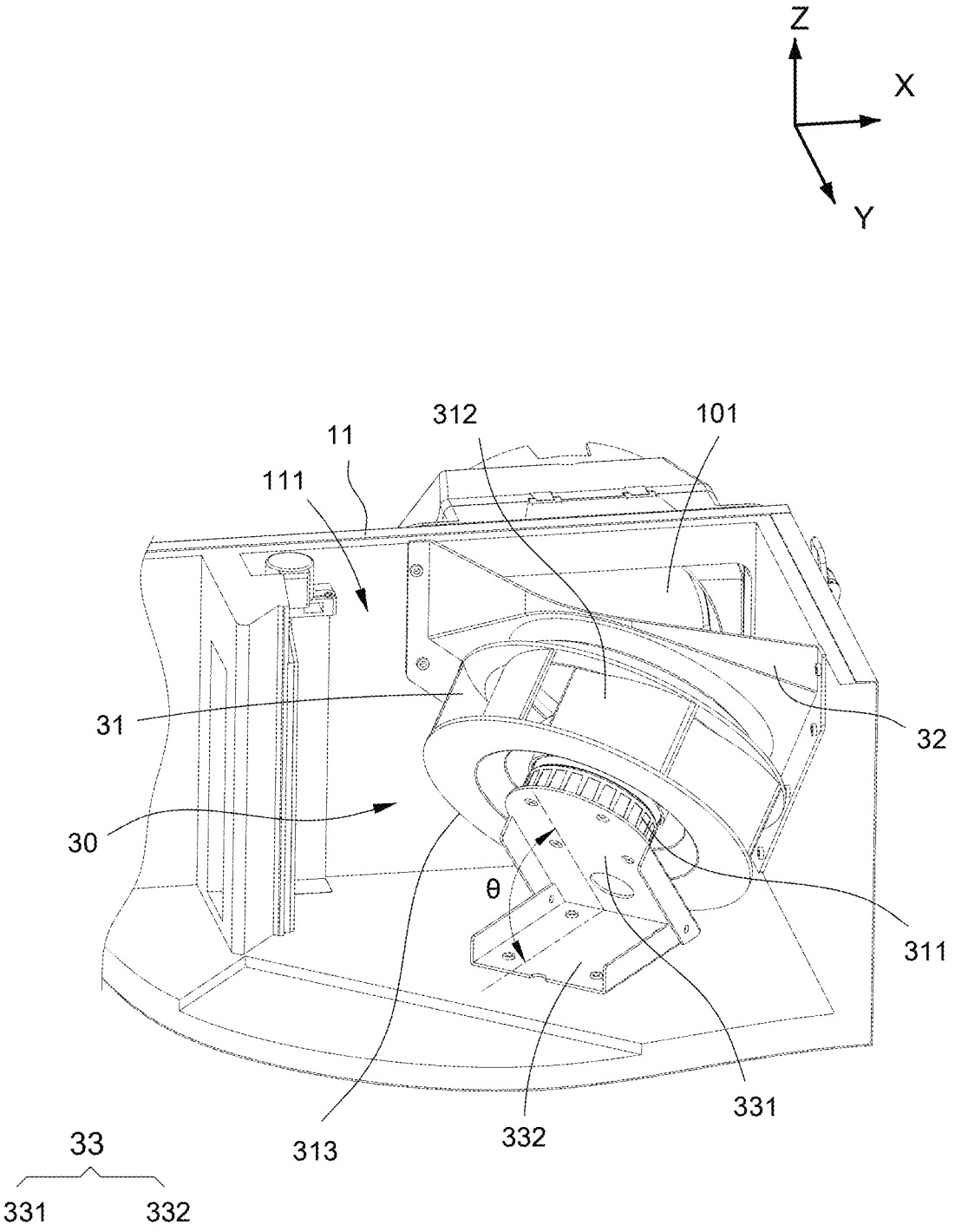
FIG. 3 depicts a partial perspective view of the first fan set according to this disclosure.

Please refer to FIG. 3, which depicts a partial perspective view of the first fan set according to this disclosure. The first fan set 30 of this disclosure is disposed in the casing 11 and located in the first space 111. The first fan set 30 includes a first open blower 31, a first guiding plate 32, and a first bracket 33. The first open blower 31 further includes a first motor 311 and a first impeller 312 driven by the first motor 311. A first outer diameter 313 is defined on the first impeller 312. The first guiding plate 32 is disposed between the outside air inlet 101 and the first open blower 31. The first bracket 33 supports the first open blower 31. The first bracket 33 includes a first supporting plate 331 and a first base plate 332 connecting with the first supporting plate 331. The first supporting plate 331 supports the first motor 311, and the first base plate 332 is connected to the casing 11. As shown in FIG. 3, the first bracket 33 may be a one-piece metal sheet, and the inclined angle θ defined between the first supporting plate 331 and the first base plate 332 is an acute angle.

Figure 4:
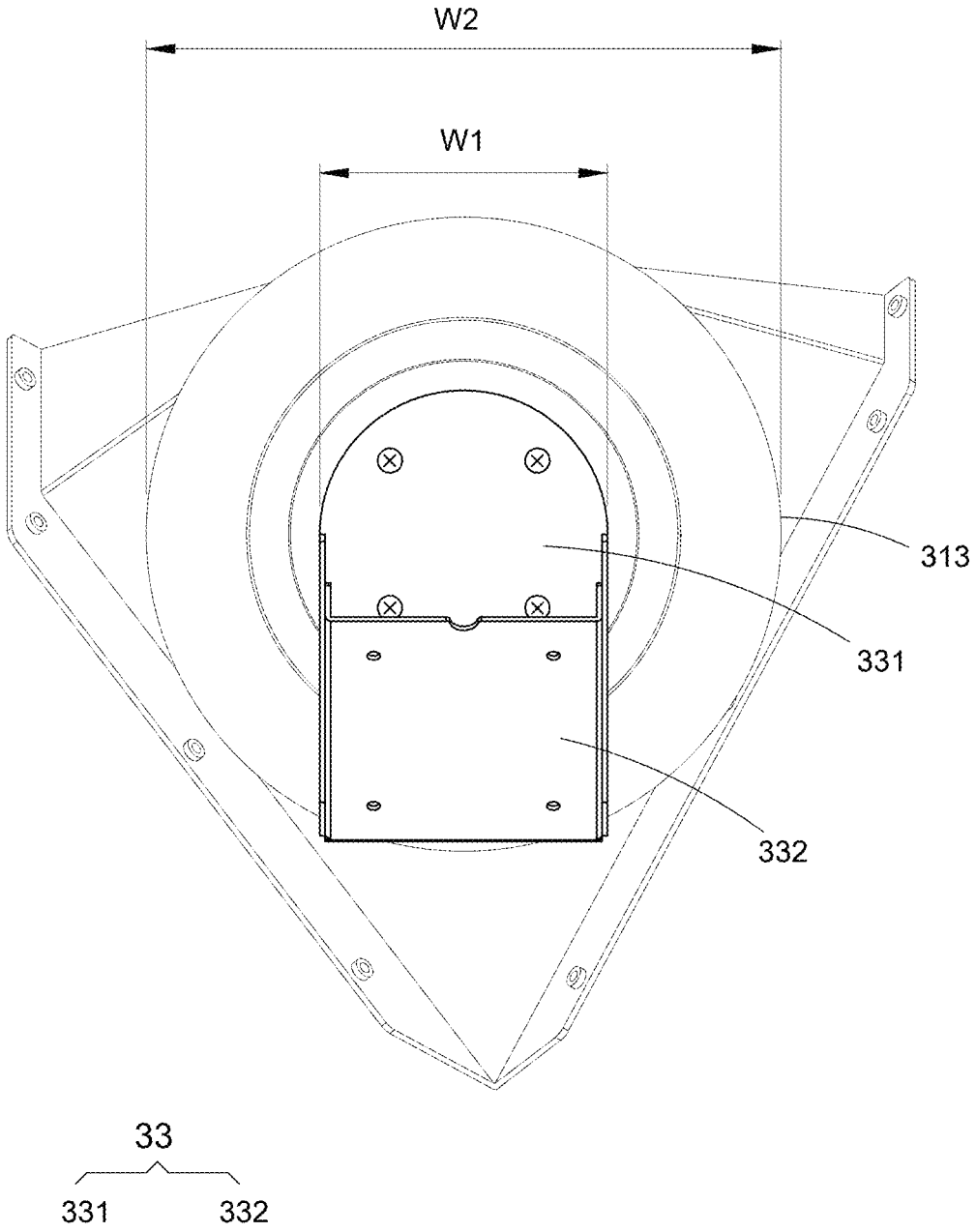
FIG. 4 depicts a plan schematic view of the first fan set from the rear side according to this disclosure.

Please refer to FIG. 4, which depicts a plan schematic view of the first fan set from the rear side according to this disclosure. A plate width W1 is defined on the first supporting plate 331. Additionally, a width W2 is defined on the first outer diameter 313. In some embodiments, the plate width W1 is equal to or less than the width W2 of the first outer diameter 313 to avoid the airflow generated by the first open blower 31 being affected by the first supporting plate 331.

Figure 5:
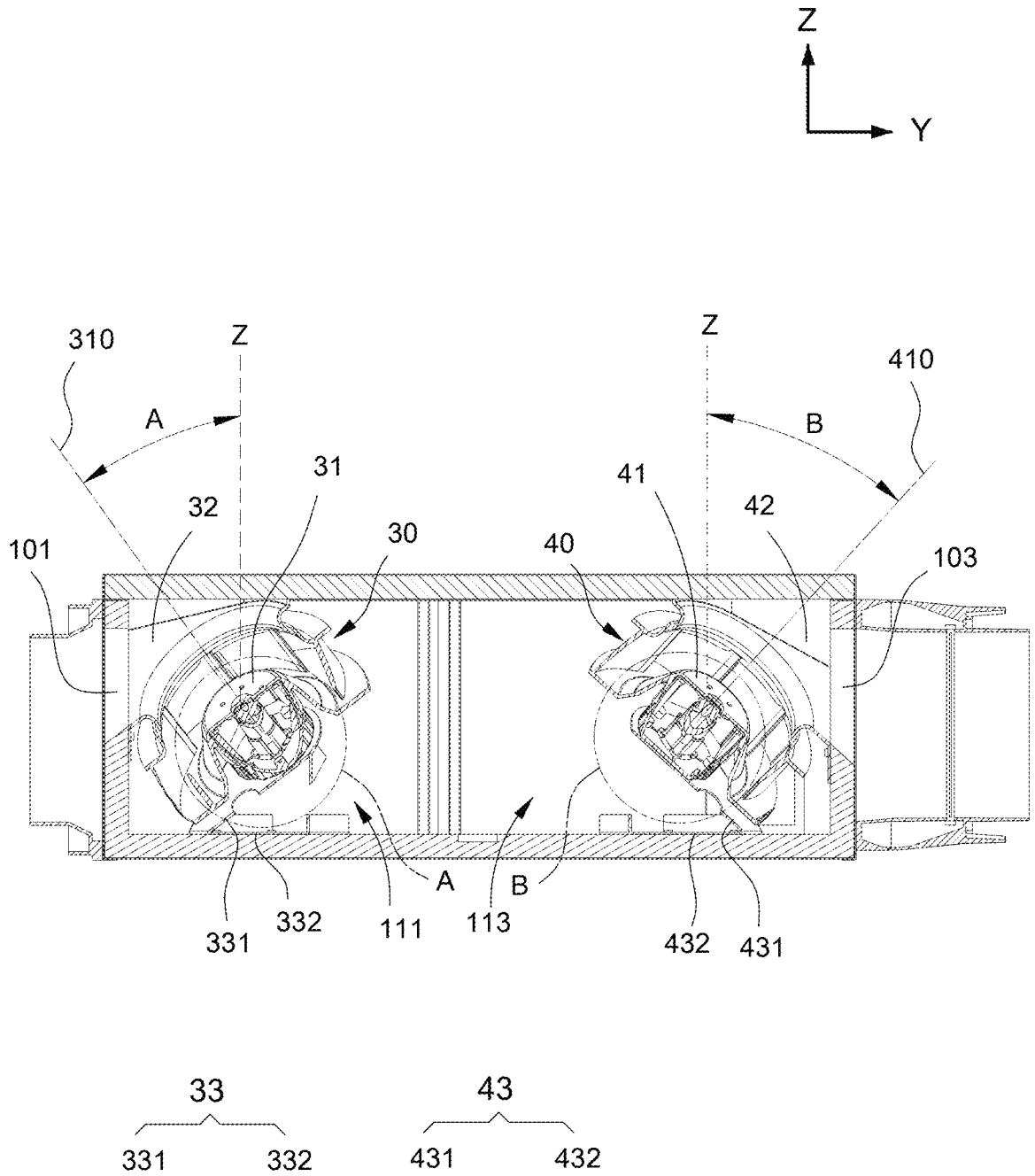
FIG. 5 depicts a cross-sectional schematic view of the energy recovery ventilator from another side according to this disclosure.

Please refer to FIG. 5, which depicts a cross-sectional schematic view of the energy recovery ventilator from another side according to this disclosure. As shown in FIG. 3, the first fan set 30 of this disclosure is arranged in the first space 111. A first rotating direction 310 is defined on the first open blower 31. The first bracket 33 supports the first open blower 31. The first open blower 31 is installed in the first space 111 and fixed on the first supporting plate 331. The first open blower 31 rotates along the first rotating direction 310. Additionally, the first fan inlet 301 of the first open blower 31 faces the outside air inlet 101 through the orientation of the first supporting plate 331 of the first bracket 33. The position of the first open blower 31 is achieved through a first offset angle A defined by the first rotating direction 310 relative to Z-axis. The first offset angle A is equal to the inclined angle θ defined between the first supporting plate 331 and the first base plate 332. The outdoor air entering from the outside air inlet 101 is guided by the first guiding plate 32 to flow into the first open blower 31 and enter the energy recovery core 20.

Moreover, the second fan set 40 is arranged in the third space 113. A second rotating direction 410 is defined on the second open blower 41. The second bracket 43 supports the second open blower 41. Thus, the second open blower 41 is installed in the third space 113. The second open blower 41 rotates along the second rotating direction 410. The second bracket 43 includes a second supporting plate 431 and a second base plate 432. The second open blower 41 is fixed on the second supporting plate 431. Additionally, the second fan inlet 401 of the second open blower 41 faces the return air inlet 103 through the orientation of the second supporting plate 431 of the second bracket 43. The position of the second open blower 41 is achieved through a second offset angle B defined by the second rotating direction 410 relative to Z-axis. The second offset angle B is equal to the inclined angle defined between the second supporting plate 431 and the second base plate 432. It is worth noticing that the indoor air entering from the return air inlet 103 is guided by the second guiding plate 42 to flow into the second open blower 41 and enter the energy recovery core 20.

Figure 6:
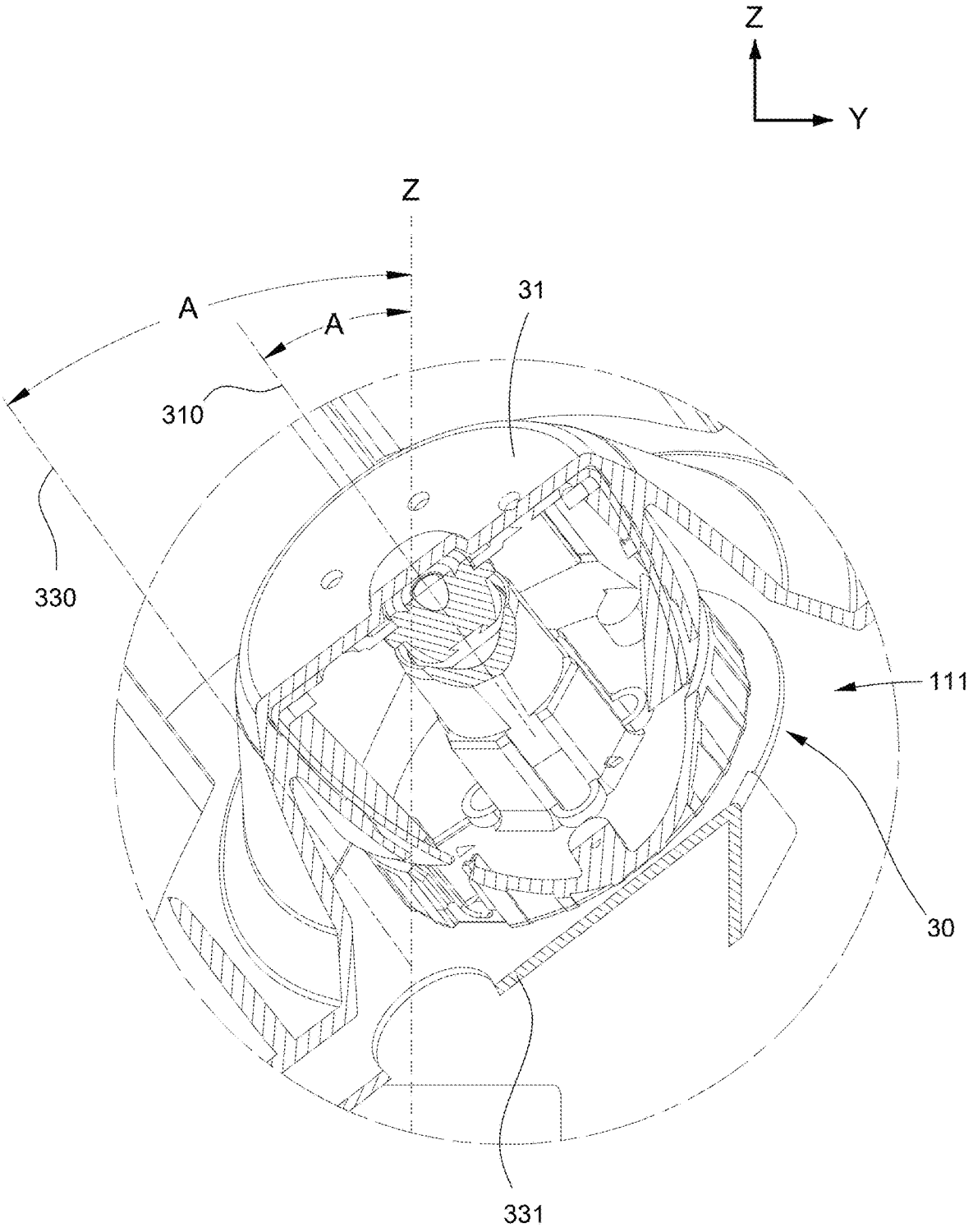
FIG. 6 depicts a partially enlarged schematic view of the A portion in FIG. 5.

Please refer to FIG. 6, which depicts a partially enlarged schematic view of the A portion in FIG. 5. The first fan set 30 of this disclosure is arranged by fixing the first bracket 33 in the first space 111, and the first supporting plate 331 tilts and supports the first open blower 31 at the inclined angle θ relative to the first base plate 332. Specifically, the first rotating direction 310 is defined on the first open blower 31. Additionally, a first normal direction 330 is defined on the first supporting plate 331, and the first normal direction 330 is parallel to the first rotating direction 310. The first normal direction 330 is set to have a first offset angle A relative to Z-axis. Since the first offset angle A is equal to the inclined angle θ, the first supporting plate 331 tilts and supports the first open blower 31 at the first offset angle A relative to the first base plate 332.

Figure 7:
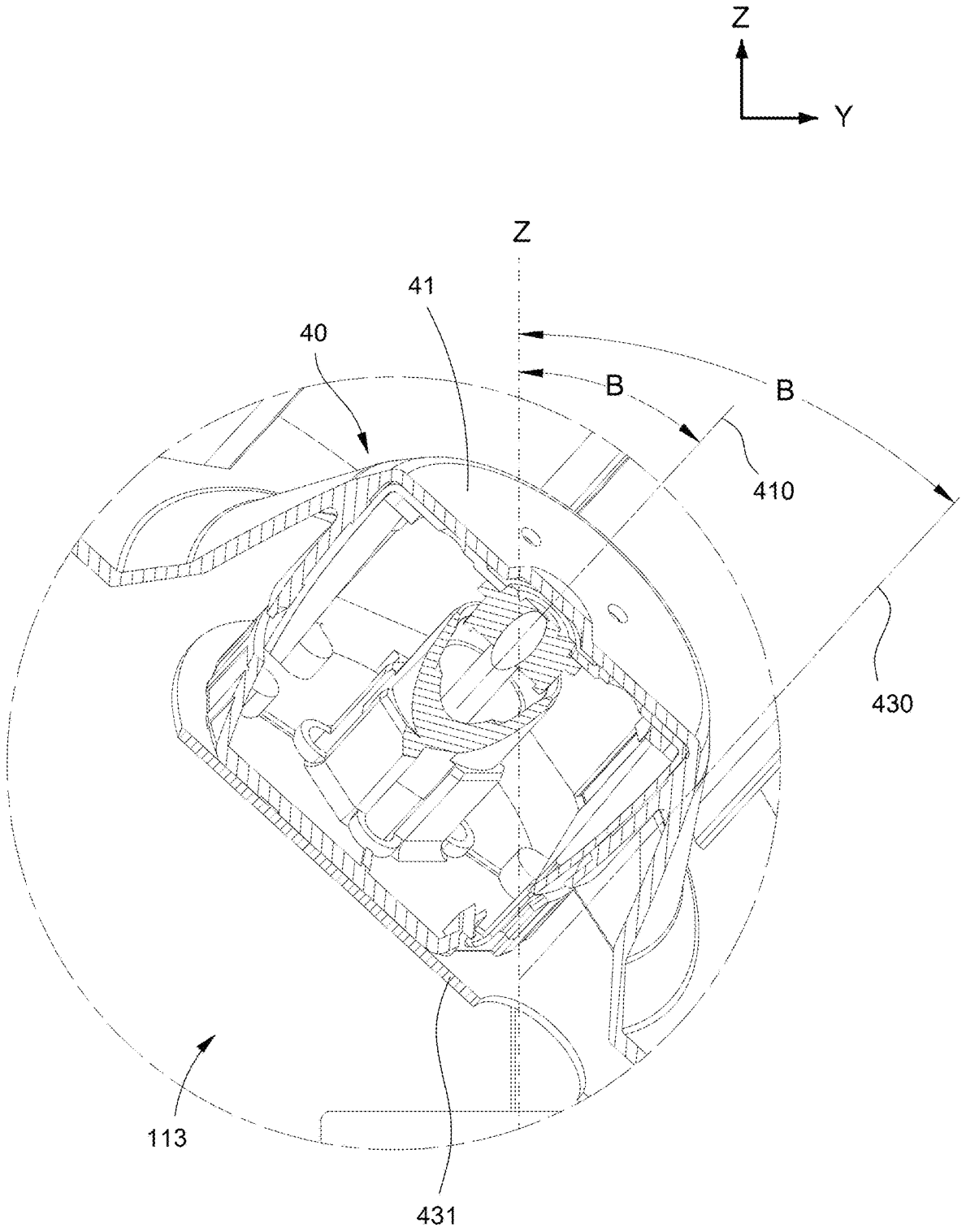
FIG. 7 depicts a partially enlarged schematic view of the B portion in FIG. 5.

Please refer to FIG. 7, which depicts a partially enlarged schematic view of the B portion in FIG. 5. The second fan set 40 of this disclosure is arranged by fixing the second bracket 43 in the third space 113, and the second supporting plate 431 tilts and supports the second open blower 41 at the inclined angle θ relative to the second base plate 432. Specifically, the second rotating direction 410 is defined on the second open blower 41. Additionally, a second normal direction 430 is defined on the second supporting plate 431, and the second normal direction 430 is parallel to the second rotating direction 410. The second normal direction 430 is set to have a second offset angle B relative to Z-axis. That is, the second supporting plate 431 tilts and supports the second open blower 41 at the second offset angle B relative to the second base plate 432.

Figure 8:
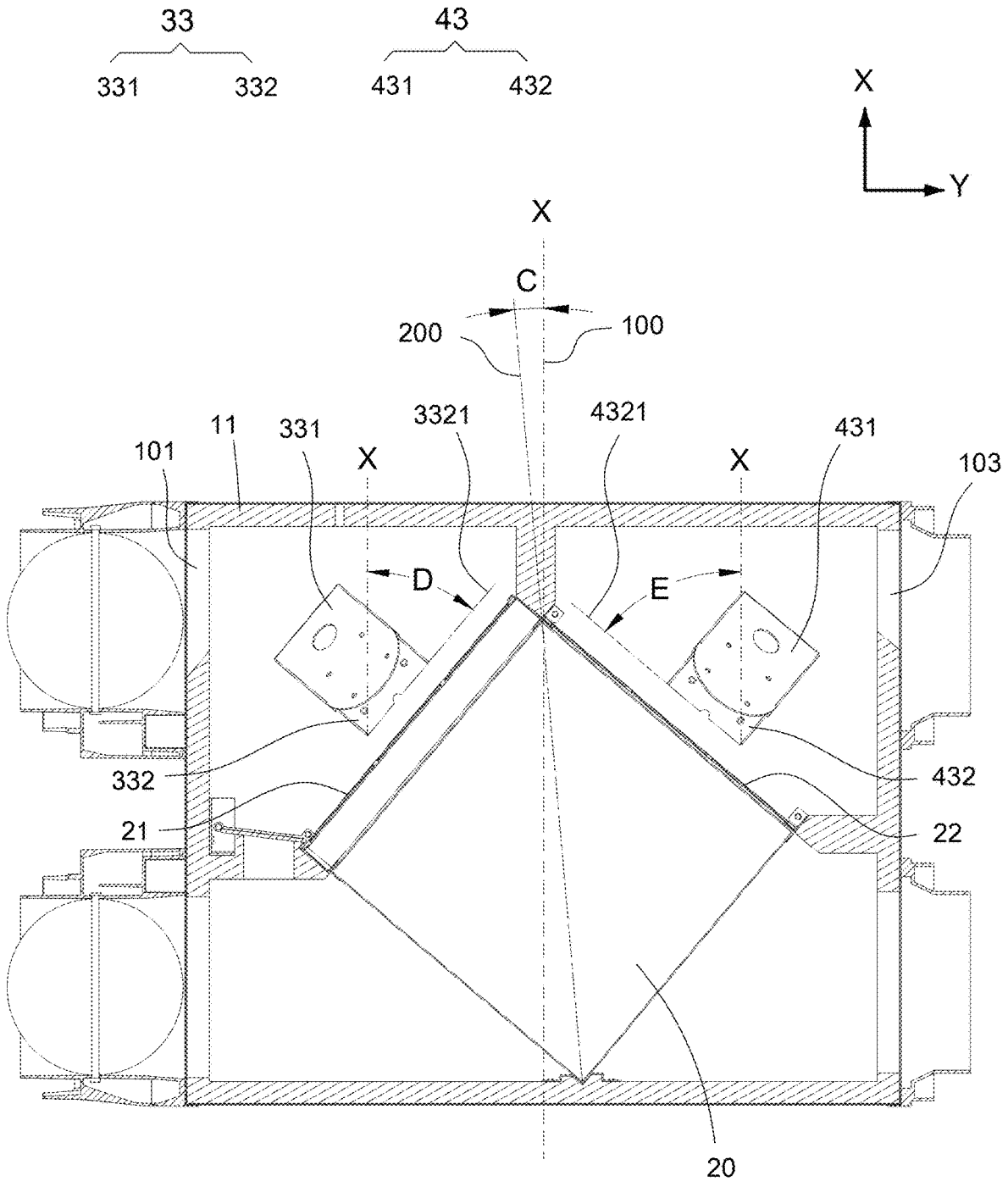
FIG. 8 depicts a cross-sectional schematic view of the energy recovery ventilator according to this disclosure.

Please refer to FIG. 8, which depicts a cross-sectional schematic view of the energy recovery ventilator according to this disclosure. A center line 100 is defined on the casing 11, and a diagonal line 200 is defined on the energy recovery core 20. Additionally, the energy recovery core 20 is arranged in the casing 11 at an offset angle C between the diagonal line 200 and the center line 100.

In more detail, the first bracket 33 is disposed between the outside air inlet 101 and the energy recovery core 20. The first base plate 332 of the first bracket 33 includes a first rear edge 3321. Furthermore, a first angle D is defined between the first rear edge 3321 and X-axis. Thus, the first rear edge 3321 faces the first inlet surface 21 of the energy recovery core 20. Additionally, the second bracket 43 is disposed between the return air inlet 103 and the energy recovery core 20. The second bracket 43 includes a second base plate 432, and the second base plate 432 includes a second rear edge 4321. A second angle E is defined between the second rear edge 4321 and X-axis. Thus, the second rear edge 4321 faces the second inlet surface 22 of the energy recovery core 20.

Figure 9:
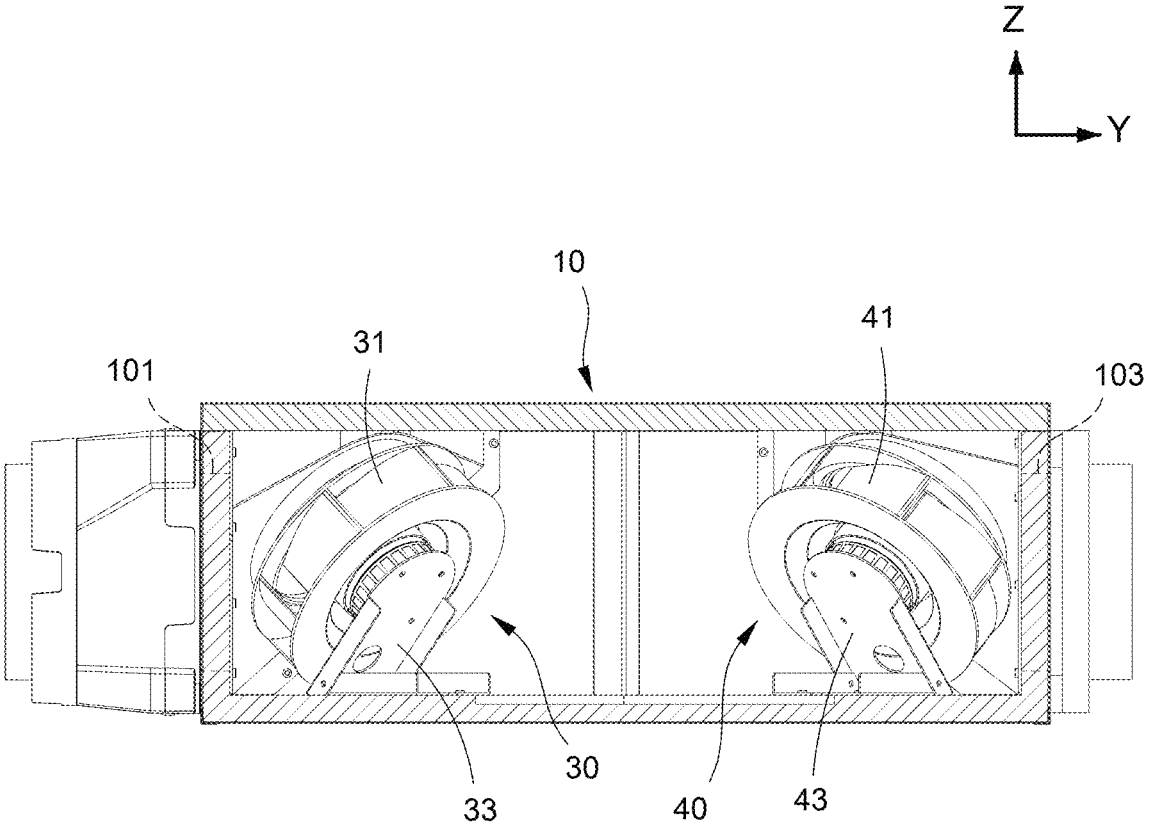
FIG. 9 depicts a cross-sectional schematic view of the energy recovery ventilator from another side according to this disclosure.

Please refer to FIG. 9, which depicts a cross-sectional schematic view of the energy recovery ventilator from another side according to this disclosure. The first fan set 30 of this disclosure is arranged on one side of the outside air inlet 101 to guide the airflow flowing in from the outside air inlet 101. The installation direction of the first fan set 30 is achieved through the disposition of the first bracket 33. Additionally, the second fan set 40 is arranged on one side of the return air inlet 103 to guide the airflow flowing in from the return air inlet 103. The installation direction of the second fan set 40 is achieved through the disposition of the second bracket 43. In this embodiment, the first bracket 33 and the second bracket 43 are fixed on the same side of the housing 10. Additionally, the air inlet directions of the first open blower 31 and the second open blower 41 are located on the same side.

Figure 10:
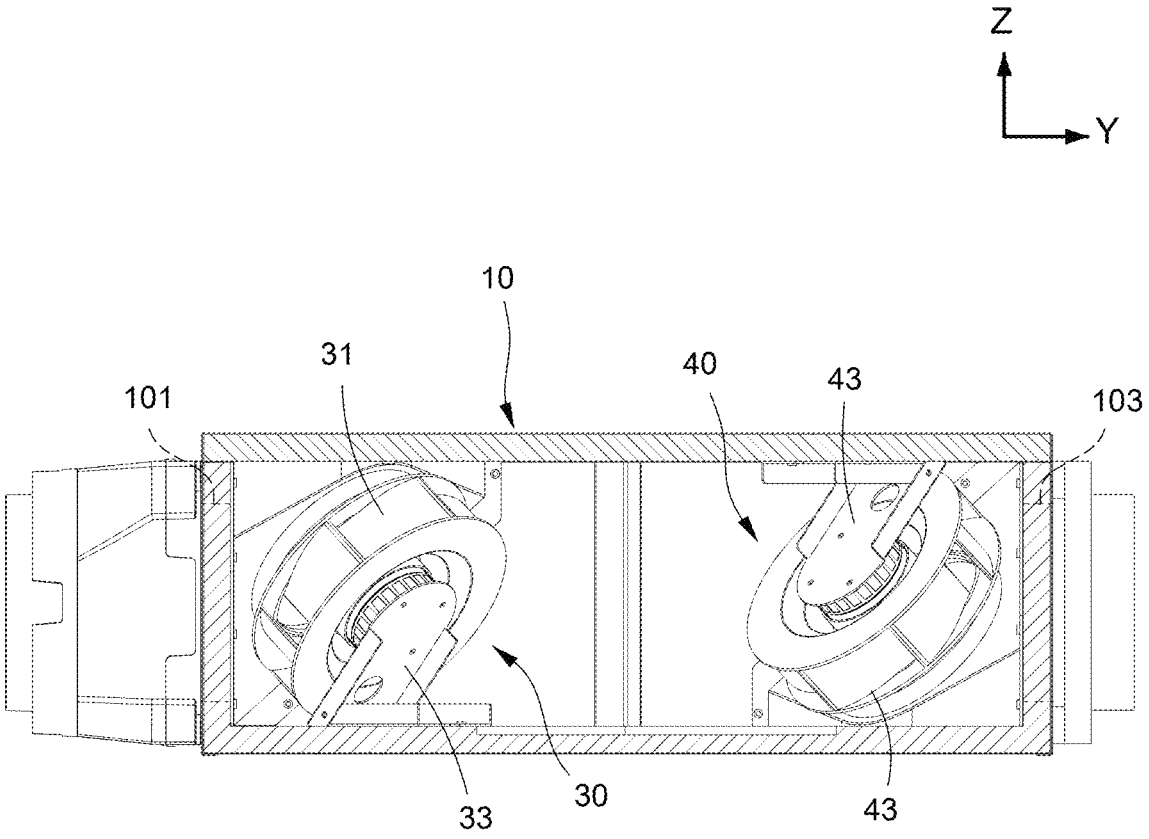
FIG. 10 depicts another embodiment of the first fan set and the second fan set according to this disclosure.

Please refer to FIG. 10, which depicts another embodiment of the first fan set and the second fan set according to this disclosure. Compared with FIG. 9, the difference in this embodiment lies in the installation directions of the first open blower 31 and the second open blower 41. The first fan set 30 is used to guide the airflow flowing in from the outside air inlet 101. The second fan assembly 40 is used to guide the airflow flowing in from the return air inlet 103. In this embodiment, the first bracket 33 and the second bracket 43 are fixed on opposite sides of the housing 10. Additionally, the air inlet directions of the first open blower 31 and the second open blower 41 are located on opposite sides of the housing 10. It is worth noting that the position of the outside air inlet 101 is defined according to the installation of the first fan set 30. Additionally, the position of the return air inlet 103 is defined according to the installation of the second fan set 40.

Figure 11:
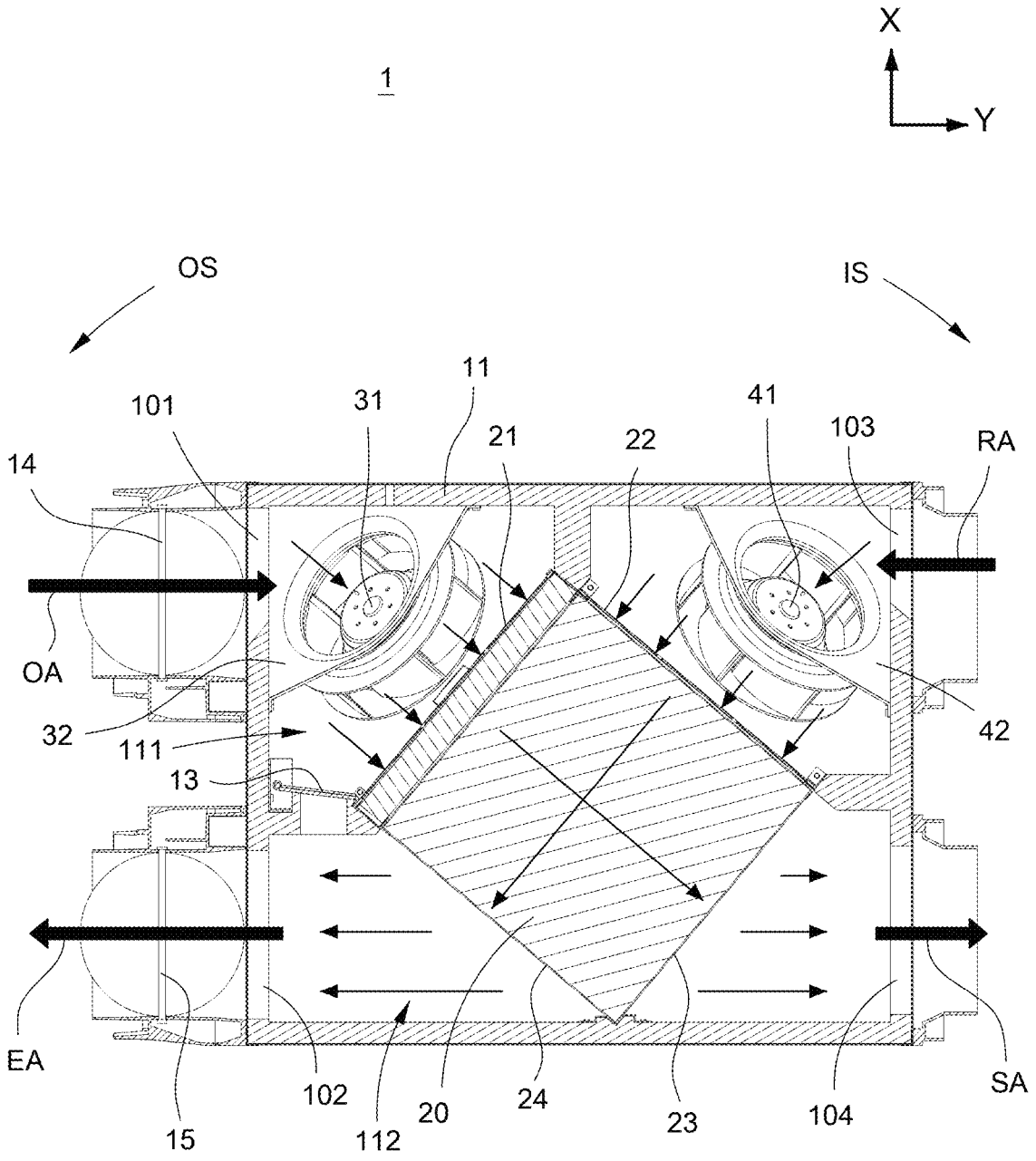
FIG. 11 depicts a bidirectional ventilation schematic view of the energy recovery ventilator according to this disclosure.

Please further refer to FIG. 11, which depicts a bidirectional ventilation schematic view of the energy recovery ventilator according to this disclosure. The energy recovery ventilator 1 of this disclosure is installed between an outdoor side (OS) and an indoor side (IS). When the energy recovery ventilator 1 is in operation, the air damper 13 is set to close (OFF) to ensure that the first space 111 and the second space 112 are in a non-communicating state. Additionally, the first damper 14 and the second damper 15 are in an open state (ON), and both the first damper 14 and the second damper 15 are driven by stepper motors. Furthermore, the first open blower 31 and the second open blower 41 are set to open (ON).

The energy recovery ventilator 1 of this disclosure has a first ventilation direction during operation. The first ventilation direction is defined as outdoor air (OA) from the outdoor side (OS) flowing into the housing 10 from the outside air inlet 101 and being guided by the first guiding plate 32 to enter the first open blower 31, and then entering the energy recovery core 20 from the first inlet surface 21. Subsequently, the outdoor air (OA) flows out of the energy recovery core 20 from the first outlet surface 23 and then flows into the indoor side (IS) from the supply air outlet 104 to form supply air (SA).

Moreover, the energy recovery ventilator 1 of this disclosure has a second ventilation direction during operation. The second ventilation direction is defined as return air (RA) flowing into the casing 11 from the return air inlet 103 and being guided by the second guiding plate 42 to enter the second open blower 41, and then entering the energy recovery core 20 from the second inlet surface 22. Subsequently, the return air (RA) flows out of the energy recovery core 20 from the second outlet surface 24 and then flows out to the outdoor side (OS) from the exhaust air outlet 102 to form exhaust air (EA).

Figure 12:
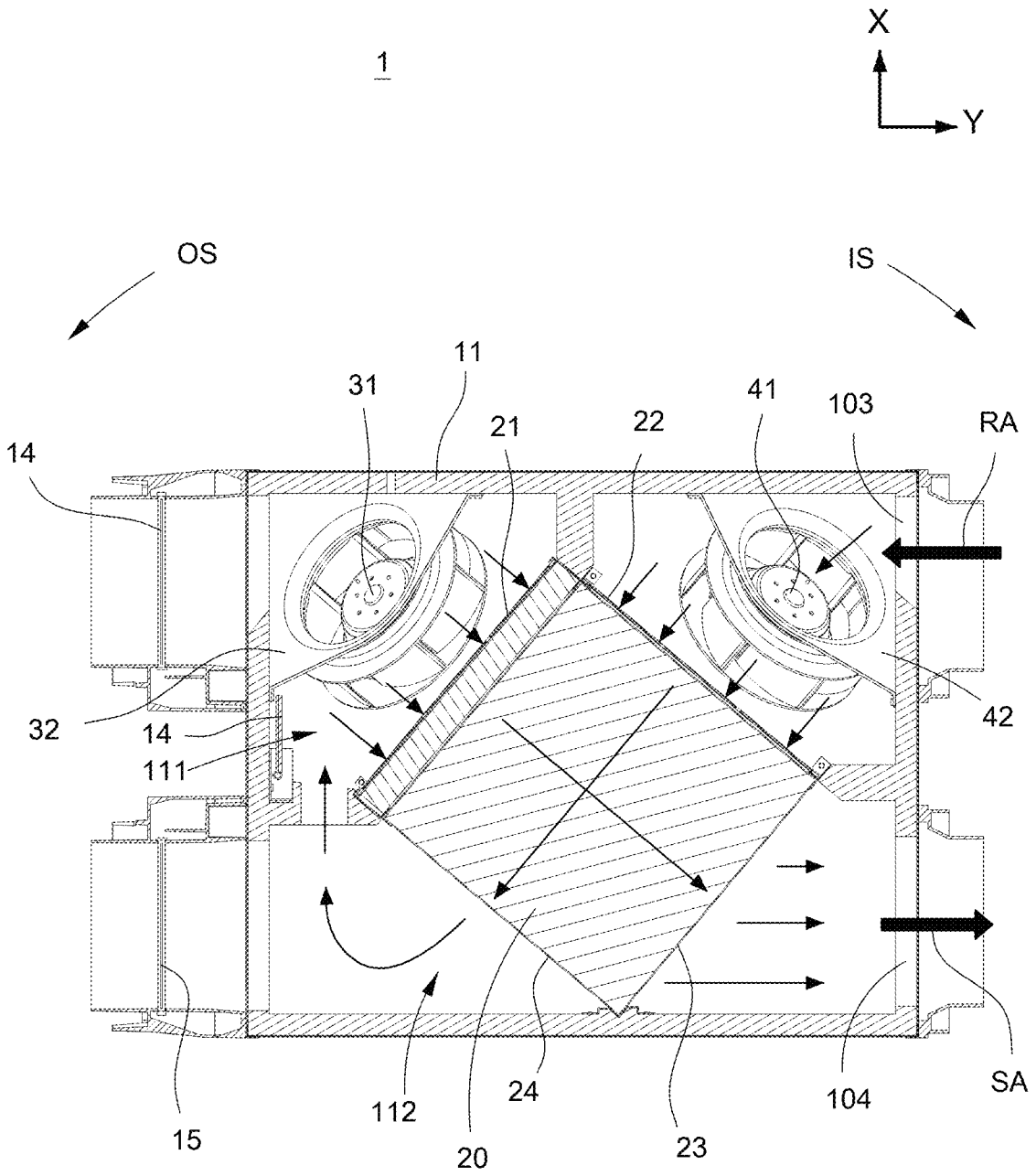
FIG. 12 depicts the indoor defrost status of the energy recovery ventilator according to this disclosure.

Please refer to FIG. 12, which depicts the indoor defrost status of the energy recovery ventilator according to this disclosure. The energy recovery ventilator 1 of this disclosure may perform a defrosting operation. As mentioned above, the energy recovery ventilator 1 is installed between the outdoor side (OS) and the indoor side (IS). When the energy recovery ventilator 1 performs the defrosting operation, the air damper 13 is set to open (ON) to make the first space 111 and the second space 112 be in a communicating state. Additionally, both the first damper 14 and the second damper 15 are in a closed state (OFF). Moreover, the first open blower 31 is set to be closed (OFF), and the second open blower 41 is set to be open (ON).

As a result, the return air (RA) flows into the casing 11 from the return air inlet 103 and is guided by the second guiding plate 42 to flow into the second open blower 41. Then, the return air (RA) enters the energy recovery core 20 from the second inlet surface 22. Subsequently, the return air (RA) flows out of the energy recovery core 20 from the second outlet surface 24 and enters the second space 112, then enters the first space 111 through the air damper 13, and enters the energy recovery core 20 again from the first inlet surface 21, flows out of the energy recovery core 20 from the first outlet surface 23, and flows into the indoor side (IS) from the supply air outlet 104.

In summary, the energy recovery ventilator 1 in this disclosure has two ventilation directions, which optimize the airflow path and increase the flow rate of outdoor air, thereby improving temperature and energy recovery efficiency. Furthermore, the energy recovery ventilator 1 of this disclosure is a thin ventilation device with a small size, compact structure, and a lightweight design to meet the installation requirements in small spaces. Therefore, the energy recovery ventilator 1 is easy to transport and install.

While this disclosure has been described by means of specific embodiments, numerous modifications and variations may be made thereto by those skilled in the art without departing from the scope and spirit of this disclosure set forth in the claims.

What is claimed is:

1. An energy recovery ventilator, comprising:

a housing, comprising a casing and a cover plate covering the casing, wherein an outside air inlet and an exhaust air outlet are defined on one side of the casing, and a return air inlet and a supply air outlet are defined on another side of the casing;

an energy recovery core, disposed in the casing, comprising a first inlet surface facing the outside air inlet and a second inlet surface facing the return air inlet;

a first fan set, comprising a first open blower, a first guiding plate, and a first bracket, wherein the first guiding plate is disposed between the outside air inlet and the first open blower, and the first bracket supports and orients the first open blower to position one end of an axis of the first open blower toward the outside air inlet and another end of the axis toward the first inlet surface of the energy recovery core; and a second fan set, comprising a second open blower, a second guiding plate and a second bracket, wherein the second guiding plate is disposed between the return air inlet and the second open blower, and the second bracket supports and orients the second open blower to position one end of an axis of the second open blower toward the return air inlet and another end of the axis toward the second inlet surface of the energy recovery core;

wherein outdoor air passes through the first guiding plate via the outside air inlet, enters the energy recovery core through the first open blower, and then flows out from the supply air outlet; and wherein indoor air passes through the second guiding plate via the return air inlet, enters the energy recovery core through the second open blower, and then flows out from the exhaust air outlet.

2. The energy recovery ventilator according to claim 1, wherein the first open blower and the second open blower are centrifugal fan impellers without volutes.

3. The energy recovery ventilator according to claim 1, wherein a first damper is disposed on the outside air inlet of the housing to control opening and closing of the outside air inlet, and a second damper is disposed on the exhaust air outlet to control opening and closing of the exhaust air outlet.

4. The energy recovery ventilator according to claim 1, wherein the casing comprises a plurality of partitions, the partitions and the energy recovery core separate an interior of the casing into a first space, a second space, a third space, and a fourth space; the first space is defined as a space between the outside air inlet and the energy recovery core, the second space is defined as a space between the exhaust air outlet and the energy recovery core, the third space is defined as a space between the supply air outlet and the energy recovery core, and the fourth space is defined as a space between the return air inlet and the energy recovery core; the first fan set is located in the first space, and the second fan set is located in the third space.

5. The energy recovery ventilator according to claim 1, wherein a center line is defined on the casing, a diagonal line is defined on the energy recovery core, and the energy recovery core is arranged in the casing by an offset angle between the diagonal line and the center line.

6. The energy recovery ventilator according to claim 1, wherein the first bracket is disposed between the outside air inlet and the energy recovery core and comprises a first supporting plate and a first base plate, and the first open blower is disposed on the first supporting plate and comprises a first motor; the first supporting plate is attached to a bottom of the first motor, and the first base plate comprises a first rear edge; a first angle is defined between the first rear edge and X-axis, and the first rear edge faces the first inlet surface of the energy recovery core; and the second bracket is disposed between the return air inlet and the energy recovery core and comprises a second supporting plate and a second base plate, and the second open blower is disposed on the second supporting plate and comprises a second motor; the second supporting plate is attached to a bottom of the second motor, and the second base plate comprises a second rear edge; a second angle is defined between the second rear edge and X-axis, and the second rear edge faces the second inlet surface of the energy recovery core.

7. The energy recovery ventilator according to claim 6, wherein the first open blower further comprises a first impeller driven by the first motor, a first outer diameter is defined on the first impeller, a plate width is defined on the first supporting plate, and the plate width is equal to or less than the first outer diameter.

8. The energy recovery ventilator according to claim 6, wherein the first open blower is supported by the first bracket and rotates in a first rotating direction; a first normal direction is defined on the first supporting plate, and the first normal direction is parallel to the first rotating direction; a first offset angle is defined between the first normal direction and Z-axis;

the second open blower is supported by the second bracket and rotates in a second rotating direction; a second normal direction is defined on the second supporting plate, and the second normal direction is parallel to the second rotating direction; and a second offset angle is defined between the second normal direction and Z-axis.

9. An energy recovery ventilator, comprising:

a housing, comprising a casing and a cover plate covering the casing, wherein the casing comprises a plurality of partitions, an outside air inlet and an exhaust air outlet defined on one side of the casing, and a return air inlet and a supply air outlet defined on another side of the casing;

an energy recovery core, disposed in the casing, comprising a first inlet surface facing the outside air inlet, a second inlet surface facing the return air inlet, a first outlet surface opposite the first inlet surface, and a second outlet surface opposite the second inlet surface, wherein the partitions of the casing and the energy recovery core separate an interior of the casing into a first space, a second space, a third space, and a fourth space; the first space is defined as a space between the outside air inlet and the energy recovery core, the second space is defined as a space between the exhaust air outlet and the energy recovery core, the third space is defined as a space between the supply air outlet and the energy recovery core, and the fourth space is defined as a space between the return air inlet and the energy recovery core;

an air damper, disposed between the first space and the second space;

a first fan set, disposed in the first space and comprising a first open blower; and a second fan set, disposed in the third space and comprising a second open blower;

wherein indoor air flows into the housing from the return air inlet, enters the second open blower, then enters the energy recovery core from the second inlet surface, flows out of the energy recovery core from the second outlet surface and enters the second space, enters the first space through the air damper, enters the energy recovery core from the first inlet surface, flows out of the energy recovery core from the first outlet surface, and flows out via the exhaust air outlet.

10. The energy recovery ventilator according to claim 9, wherein the first fan set further comprises a first guiding plate and a first bracket; the first guiding plate is disposed between the outside air inlet and the first open blower; the first bracket supports and orients the first open blower to position one end of the axis of the first open blower toward the outside air inlet and the other end of the axis toward the first inlet surface of the energy recovery core; and the second first fan set further comprises a second guiding plate and a second bracket; the second guiding plate is disposed between the return air inlet and the second open blower; the second bracket supports and orients the second open blower to position one end of the axis of the second open blower toward the return air inlet and the other end of the axis toward the second inlet surface of the energy recovery core.

11. The energy recovery ventilator according to claim 9, wherein the first open blower and the second open blower are centrifugal fan impellers without volutes.

12. The energy recovery ventilator according to claim 10, wherein the first bracket is disposed between the outside air inlet and the energy recovery core and comprises a first supporting plate and a first base plate, and the first open blower is disposed on the first supporting plate and comprises a first motor; the first supporting plate is attached to a bottom of the first motor, and the first base plate comprises a first rear edge; a first angle is defined between the first rear edge and X-axis, and the first rear edge faces the first inlet surface of the energy recovery core; and the second bracket is disposed between the return air inlet and the energy recovery core and comprises a second supporting plate and a second base plate, and the second open blower is disposed on the second supporting plate and comprises a second motor; the second supporting plate is attached to a bottom of the second motor, and the second base plate comprises a second rear edge; a second angle is defined between the second rear edge and X-axis, and the second rear edge faces the second inlet surface of the energy recovery core.

13. The energy recovery ventilator according to claim 12, wherein the first open blower is supported by the first bracket and rotates in a first rotating direction; a first normal direction is defined on the first supporting plate, and the first normal direction is parallel to the first rotating direction; and a first offset angle is defined between the first normal direction and Z-axis; and the second open blower is supported by the second bracket and rotates in a second rotating direction; a second normal direction is defined on the second supporting plate, and the second normal direction is parallel to the second rotating direction; and a second offset angle is defined between the second normal direction and Z-axis.

14. An energy recovery ventilator, comprising:

a housing, comprising a casing and a cover plate covering the casing, wherein the casing comprises a plurality of partitions; an outside air inlet and an exhaust air outlet are defined on one side of the casing; and a return air inlet and a supply air outlet are defined on another side of the casing;

an energy recovery core, disposed in the casing, comprising a first inlet surface facing the outside air inlet, a second inlet surface facing the return air inlet, a first outlet surface opposite the first inlet surface, and a second outlet surface opposite the second inlet surface; wherein the partitions of the casing and the energy recovery core separate an interior of the casing into a first space, a second space, a third space, and a fourth space; the first space is defined as a space between the outside air inlet and the energy recovery core, the second space is defined as a space between the exhaust air outlet and the energy recovery core, the third space is defined as a space between the supply air outlet and the energy recovery core, and the fourth space is defined as a space between the return air inlet and the energy recovery core;

an air damper, disposed between the first space and the second space;

a first fan set, disposed in the first space and comprising a first open blower, a first guiding plate, and a first bracket, wherein the first guiding plate is disposed between the outside air inlet and the first open blower, and the first bracket supports and orients the first open blower to position one end of the axis of the first open blower toward the outside air inlet and the other end of the axis toward the first inlet surface of the energy recovery core;

a second fan set, disposed in the third space and comprising a second open blower, a second guiding plate, and a second bracket, wherein the second guiding plate is disposed between the return air inlet and the second open blower, and the second bracket supports and orients the second open blower to position one end of the axis of the second open blower toward the return air inlet and the other end of the axis toward the second inlet surface of the energy recovery core;

wherein outdoor air passes through the first guiding plate via the outside air inlet, enters the energy recovery core through the first open blower, and then flows out from the supply air outlet;

wherein indoor air passes through the second guiding plate via the return air inlet, enters the energy recovery core through the second open blower, and then flows out from the supply air outlet;

wherein indoor air flows into the housing from the return air inlet, enters the second open blower, then enters the energy recovery core from the second inlet surface, flows out of the energy recovery core from the second outlet surface and enters the second space, enters the first space through the air damper, enters the energy recovery core from the first inlet surface, flows out of the energy recovery core from the first outlet surface, and flows out via the supply air outlet.

15. The energy recovery ventilator according to claim 14, wherein the first open blower and the second open blower are centrifugal fan impellers without volutes.

16. The energy recovery ventilator according to claim 14, wherein the first bracket is disposed between the outside air inlet and the energy recovery core and comprises a first supporting plate and a first base plate, and the first open blower is disposed on the first supporting plate and comprises a first motor; the first supporting plate is attached to a bottom of the first motor, and the first base plate comprises a first rear edge; a first angle is defined between the first rear edge and X-axis, and the first rear edge faces the first inlet surface of the energy recovery core; and the second bracket is disposed between the return air inlet and the energy recovery core and comprises a second supporting plate and a second base plate, and the second open blower is disposed on the second supporting plate and comprises a second motor; the second supporting plate is attached to a bottom of the second motor, and the second base plate comprises a second rear edge; a second angle is defined between the second rear edge and X-axis, and the second rear edge faces the second inlet surface of the energy recovery core.

17. The energy recovery ventilator according to claim 16, wherein the first open blower is supported by the first bracket and rotates in a first rotating direction; a first normal direction is defined on the first supporting plate, and the first normal direction is parallel to the first rotating direction; a first offset angle is defined between the first normal direction and Z-axis; and the second open blower is supported by the second bracket and rotates in a second rotating direction; a second normal direction is defined on the second supporting plate, and the second normal direction is parallel to the second rotating direction; a second offset angle is defined between the second normal direction and Z-axis.

* * * * *